United States Patent [19]

Murayama et al.

[11] Patent Number: 4,818,195

[45] Date of Patent: Apr. 4, 1989

[54] SCROLL COMPRESSOR WITH VALVED PORT FOR EACH COMPRESSION CHAMBER

[75] Inventors: Akira Murayama; Naoshi Uchikawa; Ryoichi Kuroshima; Hiroaki Kuno; Tetsuya Arata; Masao Shiibayashi, all of Shimizu, Japan

[73] Assignee: Hitachi, Ltd., Tokyo, Japan

[21] Appl. No.: 208,110

[22] Filed: Jun. 17, 1988

Related U.S. Application Data

[63] Continuation of Ser. No. 14,476, Feb. 13, 1987, abandoned.

[30] Foreign Application Priority Data

Feb. 26, 1986 [JP] Japan ..... 61-39223

[51] Int. Cl.[4] ..... F04C 18/04; F04C 29/08

[52] U.S. Cl. ..... 418/15; 418/55

[58] Field of Search ..... 418/14, 15, 55, 57

[56] References Cited

U.S. PATENT DOCUMENTS 4,389,171 6/1983 Eber et al. ..... 418/15
4,497,615 2/1985 Griffith ..... 418/55

FOREIGN PATENT DOCUMENTS 2338808 2/1974 Fed. Rep. of Germany ..... 418/55
58-128485 8/1983 Japan ..... 418/15

*Primary Examiner*—John J. Vrablik
*Attorney, Agent, or Firm*—Antonelli, Terry & Wands

[57] ABSTRACT

A scroll compressor is provided with a two groups of commmunication ports formed in and extending through an end plate of a stationary scroll member. Each group includes two or more communication ports. A lead valve is associated with each of the two groups of communication ports and is operable by a pressure differential in between an associated compression chamber and the discharge chamber to communicate the communication ports of the group to the discharge chamber to prevent the occurrence of over-compression in the compression chamber.

5 Claims, 9 Drawing Sheets

SCROLL COMPRESSOR WITH VALVED PORT FOR EACH COMPRESSION CHAMBER

This application is a divisional of application Ser. No. 014,476, filed on Feb. 13, 1987, abandoned.

BACKGROUND OF THE INVENTION

The present invention relates to a scroll compressor including means for eliminating over-compression.

A scroll compressor is a constant-volume type compressor in which the ratio between the volume at which a gas is sucked and the volume to which the gas is finally compressed is constant. Therefore, when this type of compressor is operated at a compression ratio smaller than a predetermined set value, the pressure in the compression chamber becomes higher than the discharge pressure to be obtained. This phenomenon is generally referred to as "over-compression". The over-compression unnecessarily loads the compressor resulting in an uneconomical consumption of driving power.

The over-compression can be avoided by an arrangement wherein the gas in the compression chamber is relieved to the discharge side of the compressor when the pressure in the compression chamber has become higher than the discharge pressure of the compressor. An example of such an arrangement is disclosed in, for example, U.S. Pat. No. 4,389,171. This patent, however, does not disclose critical design conditions necessary for preventing over-compression over the entire period of compression, i.e., from the moment at which the suction of the gas is completed to the moment at which the compression is finished, such as the positions of gas relief ports with respect to the number of turns of the scroll wrap, the number of the gas relief ports and the construction of valve means for selectively opening and closing these relief ports. Thus, the arrangement disclosed in the above-mentioned United States patent can prevent over-compression over only a limited portion of the entire compression period and cannot be applied to compressors for air-conditioners each of which have a small number of turns of the scroll wrap and to refrigerator compressors each of which have a large number of turns of the scroll wrap.

SUMMARY OF THE INVENTION

Accordingly, an object of the present invention is to provide a scroll compressor which is capable of preventing any tendency of over-compression over widened angles of operation of the scroll compressor, i.e., from the completion of the suction of a gas to the completion of the compression thereof.

The scroll compressor according to the present invention includes an orbiting scroll member and a stationary scroll member. Each scroll member has an end plate and a substantially spiral wrap protruding substantially perpendicularly from one side of the end plate. The scroll members are assembled with their wraps engaged with each other so that a plurality of closed spaces are defined between the wraps and the end plates to form compression chambers. The orbiting scroll member is adapted to make an orbiting motion with respect to the stationary scroll member so that the compression chambers are progressively moved towards the center of the wrap of the stationary scroll member while the volumes of the compression chambers are progressively decreased to compress a gas sucked into the spaces. Communication port means are associated with each compression chamber to communicate the same with a discharge chamber in which a discharge pressure is built up. A valve member is associated with the communication port means associated with each compression chamber and adapted to open the associated communication port means due to a difference in pressure between the compression chamber and the discharge chamber. The communication port means associated with each compression chamber comprises a plurality of communication ports formed in the end plate of the stationary scroll member. The distance, expressed in terms of a wrap angle $\Delta\lambda$, between the communication ports which are successively opened to the same compression chamber in accordance with the orbiting motion of the orbiting scroll member is determined to meet the following condition:

$$0<\Delta\lambda<2\pi.$$

In operation, the orbiting scroll member is driven by a driving motor so as to make an orbiting motion with respect to the stationary scroll member, so that the volume of each compression chamber is progressively decreased to compress the gas which has been sucked into the compression chamber. The compressed gas is finally delivered to the discharge chamber. In the event that the pressure of the gas in the compression chamber tends to be raised above the pressure in the discharge chamber, the valve is opened, so that the gas is relieved into the discharge chamber without being compressed to the final volume, thus lowering the pressure in the compression chamber which is still in an intermediate phase of its compression stroke. Since the communication holes are adapted to be opened and closed by a single over-compression prevention valve, the pressure-relieving operation for lowering the pressure in the compression chamber can be effected by the operation of the over-compression prevention valve whenever the pressure in the compression chamber has exceeded the pressure in the discharge chamber during each stroking of the compression chamber from the completion of suction till the completion of compression.

DESCRIPTION OF THE PREFERRED EMBODIMENTS

Figure 1:
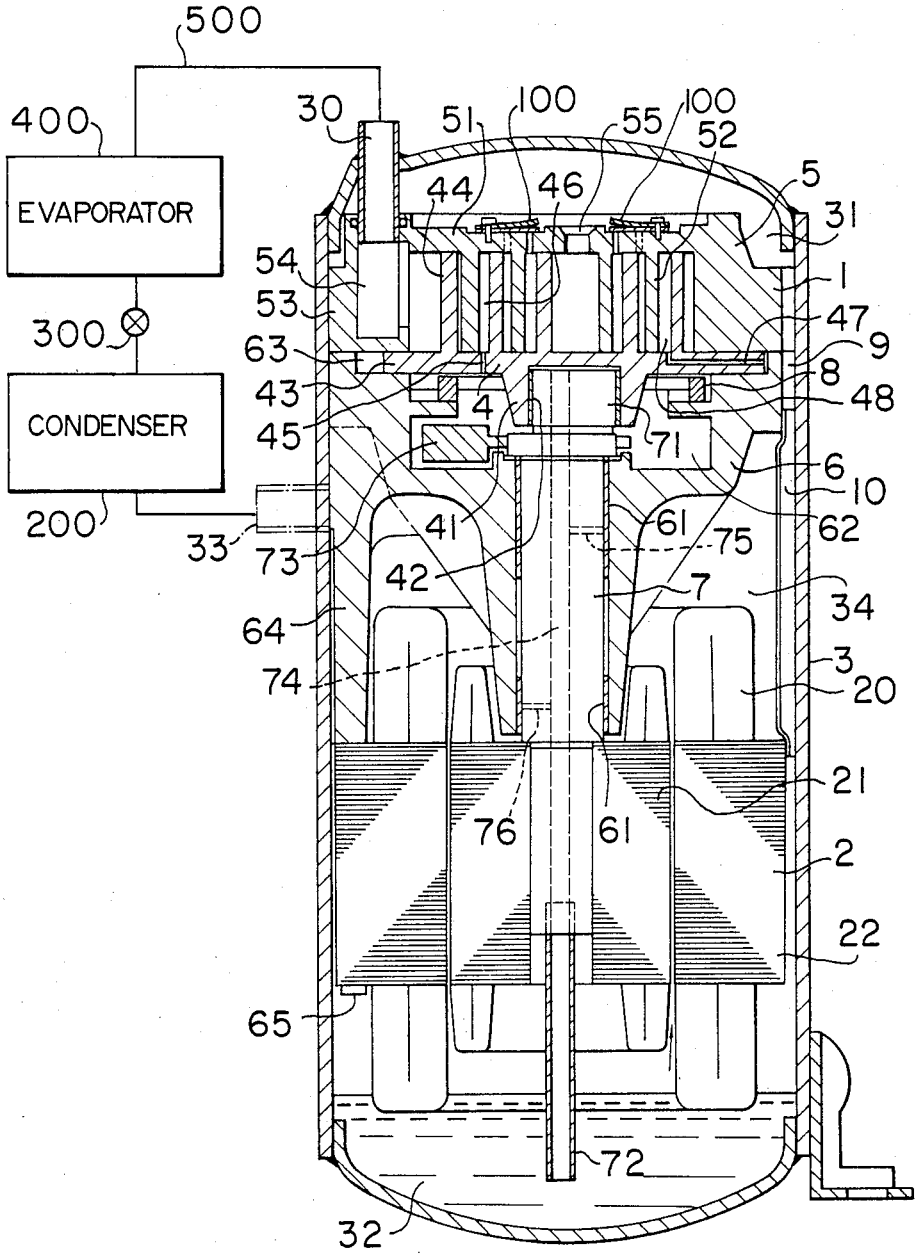
FIG. 1 is a sectional view of the whole of an embodiment of the scroll compressor in accordance with the present invention.

Referring first to FIG. 1, the scroll compressor has a hermetic casing 3 accommodating a compressor section 1 and a motor section 2 disposed in the upper and lower portions of the space in the casing 3. The compressor section 1 includes an orbiting scroll member 4 and a stationary scroll member 5 which meshes with the orbiting scroll member 4. The compressor section 1 is secured by, for example, bolts to a frame 6 which, in turn, is received in and fixed to the casing 3. A crankshaft 7 has a crank pin 71 formed on one end thereof and a lubricating oil suction pipe 72 connected to the other end thereof. The crank pin 71 is received in and supported by an orbiting bearing 42 which is provided in a boss portion 41 formed on the orbiting scroll member 4. The crankshaft 7 is also provided with a balance weight 73 attached thereto. The crankshaft 7 is rotatably supported on the frame 6 by main bearings 61 fixed to the frame 6.

The motor section 2 has a rotor 21 which is fixed to a lower portion of the crankshaft 7. A member 8 is disposed between the frame 6 and the back face of an end plate 43 of the orbiting scroll member 4 and prevents the orbiting scroll member 4 from rotating about its own axis so that the orbiting scroll member 4 makes an orbiting movement when the crankshaft 7 is rotated.

The orbiting scroll member 4 has a wrap 44 which has a form resembling a spiral form and which is formed on the end plate 43. A back pressure port 45 is formed in the end plate 43 so as to provide a communication between a compression chamber 46 and a back pressure chamber 62. The end plate 43 is also provided with an oil returning port 47 which opens at its one end to another compression chamber 48 and at its other end to a space defined in a recess 63 formed in the frame 6.

The stationary scroll member 5 has a spiral wrap 52 formed on an end plate 51. The outermost portion of the wrap 52 constitutes an outer wall 53 in which is formed a suction port 54 communicating with a gas suction pipe 30. A discharge port 55 is formed in the end plate 51 of the stationary scroll member 5 at the center of the spiral wrap 52 and opens into a discharge chamber 31.

The described embodiment of the scroll compressor in accordance with the present invention has a pair of over-compression prevention valves 100. The detail of the over-compression prevention valves will be explained hereinunder with specific reference to FIGS. 2 and 3. The pair of over-compression prevention valves 100 are arranged so as to correspond to the respective compression chambers A and B which are defined by the wraps 44 and 52 of the scroll members 4 and 5.

Figure 2:
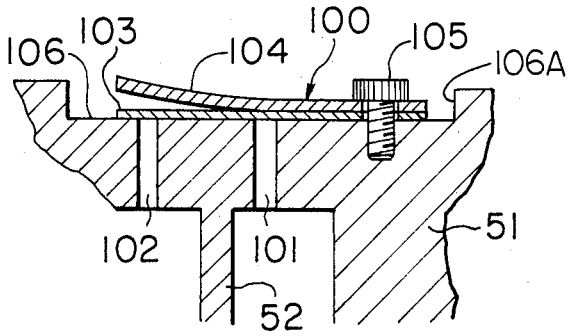
FIG. 2 is an enlarged sectional view of an over-compression prevention valve of the scroll compressor shown in FIG. 1.

The end plate 51 of the stationary scroll member 5 is provided with two pairs of communication ports 101 and 102 and 111 and 112, only one of these pairs being shown in FIG. 2. As will be seen from FIG. 2, the end openings of the communication ports 101 and 102 opposite to the wrap 52 are covered by a valve plate 103 which may be a lead valve having a fixed substantially radially directed outer end and a free substantially radially directed inner end so as to extend along a chord. A valve retainer plate 104 for limiting the deformation of the valve plate 103 is fastened at its base end to the end plate 51 by, for examples a fixing bolt 105 together with the fixed radially directed outer end of the valve plate 103. A valve seat 106 is formed by a planar bottom face of a recess 106A in the end plate 51 which bottom face is finely finished so that a high degree of gas tightness is provided between the valve seat and the valve member 103.

Figure 3:
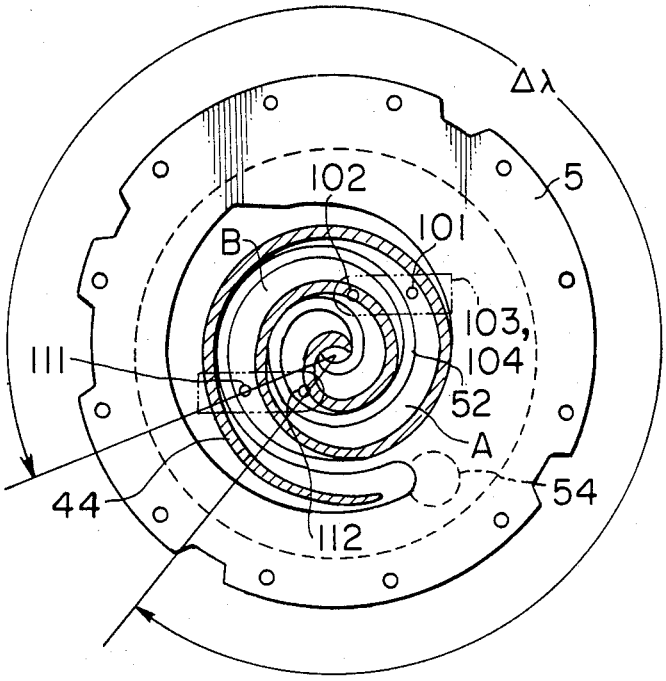
FIG. 3 is a partially sectional plan view illustrating the positional relationship between over-compression prevention valves and the wraps of orbiting and stationary scroll members.
Figure 4A:
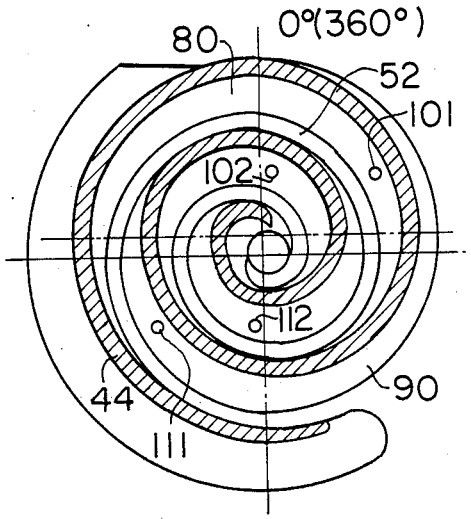
FIGS. 4A to 4D are illustrations of scroll wraps in different phases of orbiting motion of the orbiting scroll member.
Figure 4B:
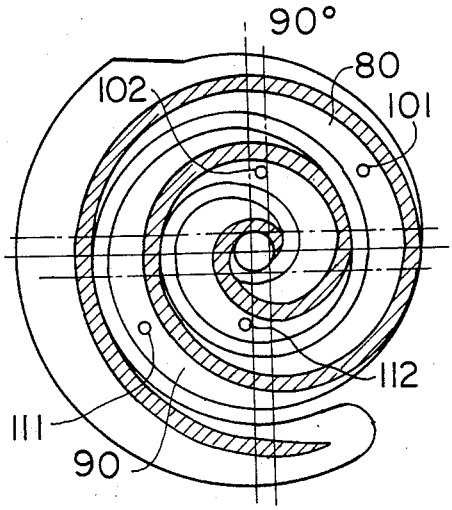
Figure 4D:
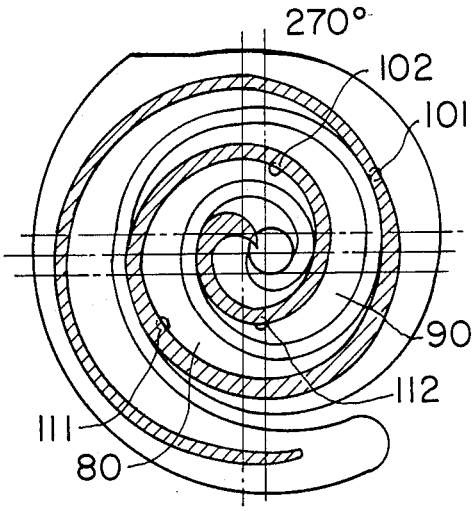
Figure 4C:
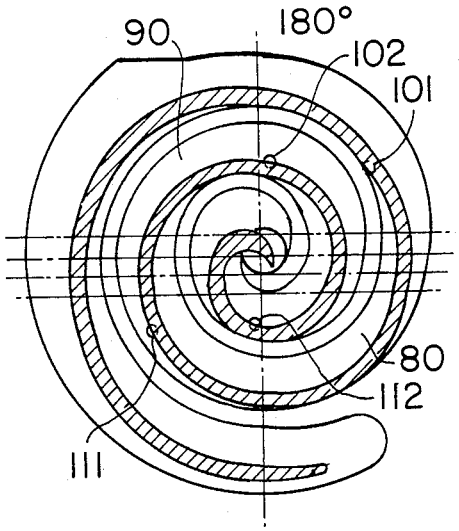

As shown in FIG. 3, the pairs of communication ports 101 and 102 and 111 and 112 are disposed so as to be able to prevent over-compression over the whole of the region where the compression chambers A and B are formed. The communication ports 101 and 102 are adapted to be successively opened to the compression chamber A as the compression chamber A is moved in accordance with the orbiting movement of the orbiting scroll member 4. Similarly, the communication ports 111 and 112 are successively opened to the compression chamber B as the chamber B moves in accordance with the orbiting movement of the orbiting scroll member 4. The wrap angle between the communication ports 101 and 102 and the wrap angle between the communication ports 111 and 112 are each represented by $\Delta\lambda$ which is selected to meet the following condition:

$$0<\Delta\lambda<2\pi.$$

It is to be noted that the following condition should be met;

$$L+D/2>T$$

where, D represents the diameter of each communication port, L represents the distance between the center of each communication port and an associated wrap and T represents the wall thickness of the wrap.

FIGS. 4A to 4D show the relationships between the positions of the compression chambers and the positions of the communication ports in different angles or phases of orbiting motion of the orbiting scroll member. In the state shown in FIG. 4A, a compression chamber 80 is in communication with the communication port 101, while another compression chamber 90 is in communication with the other communication port 111. In the state shown in FIG. 4B, the orbiting scroll member 4 has made orbiting movement through 90° from the position shown in FIG. 4A. In this state, however, the compression chambers 80 and 90 are still in communication with the communication ports 101 and 111, respectively, as in the state shown in FIG. 4A. In the state shown in FIG. 4C, in which the orbiting scroll member has made orbiting movement through 180° from the state shown in FIG. 4A, the compression chamber 80 is still in communication with the communication port 101, while the compression chamber 90 communicates with both the communication ports 111 and 102. In the state shown in FIG. 4D, in which the orbiting scroll member has made orbiting movement through 270° from the state shown in FIG. 4A, the compression chamber 80 is in communication with the communication ports 111 and 102, while the compression chamber 90 communicates with the communication port 112.

Thus, both compression chambers 80 and 90 are held in communication with at least one of the communication holes substantially all over the compression stroke.

Therefore, the over-compression prevention valves operate to relieve the compressed gas whenever the pressure is increased in compression chambers beyond the level of the pressure in the discharge chamber.

Referring again to FIG. 1, the motor section 2 has a stator 22 which is fixed by, for example, bolts 65 to the legs 64 of the frame 6. A lubricating oil supply passage 74, which communicates at its lower end with the lubricating oil suction pipe 72, is formed in the crankshaft 7 so as to extend in the axial direction of the crankshaft 7. The lubricating oil supply passage 74 is communicated with lubricating oil ports 75 and 76 which open in the main bearings 61. The lower end of the lubricating oil suction pipe 72 is immersed in an oil reservoir 32 formed in the bottom portion of the casing 3, so that a lubricating oil sucked up from the oil reservoir 32 is supplied to the main bearings 61 through the lubricating oil suction pipe 72, the lubricating oil supply passage 74 and the lubricating oil ports 75 and 76, thereby lubricating the main bearings 61.

A discharge pipe 33 is fixed to the casing 3 and extends to a motor chamber 34 in the casing 3 through the wall thereof. A passage 9 provides a communication between the discharge chamber 31 and the motor chamber 34. A guide channel 10 is formed along the inner peripheral surface of the casing 3 and extends downward so as to open in a region near the upper end portion 20 of the coil of the motor section 2.

The discharge pipe 33 of the scroll compressor is connected to an inlet side of a condenser 200 which is connected at its outlet side to an expansion valve 300. The outlet side of the expansion valve 300 is connected to an inlet side of an evaporator 400 the outlet side of which is connected through a line 500 to the aforementioned gas suction pipe 30 of the scroll compressor. The scroll compressor, the condenser 200, the expansion valve 300 and the evaporator 400 in combination constitute a refrigeration cycle.

In operation, when the motor 2 is operated, the crankshaft 7 is rotated so that the orbiting scroll member 4 makes an orbiting movement with respect to the stationary scroll member 5 because the afore-mentioned member 8 prevents the orbiting scroll member 4 from rotating about its own axis. As a result, the compresend plates 43 and 51 of both scroll members 4 and 5 are progressively moved towards the center of the compressor while decreasing their volumes, so that the gas sucked into these compression chambers is progressively compressed and discharged into the discharge chamber 31 through the discharge port 55.

The back-pressure chamber 62 is formed on the rear side of the orbiting scroll member 4. A part of the gas which is being compressed is introduced into the back-pressure chamber 62 through a back-pressure port 45, so that an intermediate pressure higher than the suction pressure but lower than the discharge pressure is maintained in the back-pressure chamber 62. This intermediate pressure produces a controlled force by which the orbiting scroll member 4 is urged against the stationary scroll member 5 so that the axial end surfaces of the wraps of both scroll members 4, 5 are in slidable sealing engagement with the opposing end plates to prevent the leakage of gas thereby ensuring a high efficiency of operation of the scroll compressor. The gas at a high pressure and a high temperature is discharged through the discharge pipe 33 and then liquefied in the condenser 200 and thereafter expanded by the expansion valve 300 to a lower pressure so as to be evaporated and heated by exchanging heat with, for example, air in the evaporator 4. The heated gas is then sucked into the scroll compressor through the line 500 and the suction pipe 30. During the operation of the compressor, the discharge pressure acts on the lubricating oil in the oil reservoir 32 in the bottom of the hermetic casing 3 so that the lubricating oil is supplied through the lubricating oil suction pipe 72 and the oil supply passage 74 due to the difference between the discharge pressure and the intermediate pressure maintained in the back-pressure chamber 62. The lubricating oil is collected in the back-pressure chamber 62 and is supplied into the compression chambers through the back-pressure port 45 and the oil return port 47. The oil is then discharged together with the compressed gas into the discharge chamber 31. The compressed gas, suspending the lubricating oil, is then introduced into the motor chamber 34 through the passage 9 and along the guide channel 10. The compressed gas, on its way to the discharge pipe 33, collides with various component parts of the motor section 2 so that the lubricating oil is separated from the compressed gas and collected in the oil reservoir 32.

Figure 5:
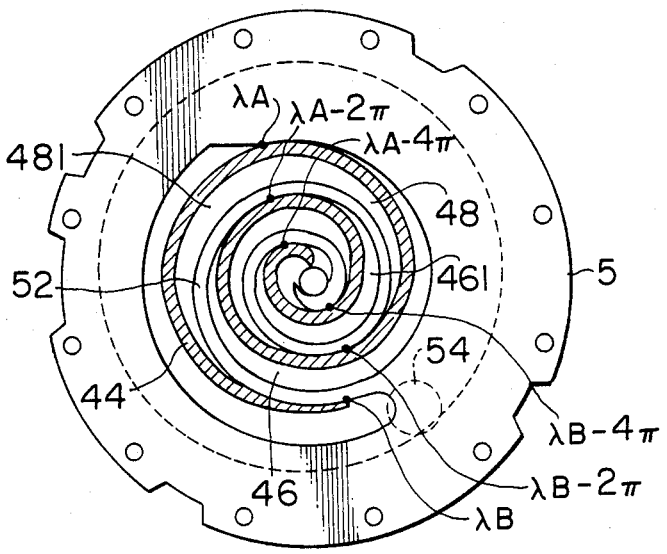
FIG. 5 is an illustration of the manner in which a compression chamber is formed in the scroll compressor.
Figure 6:
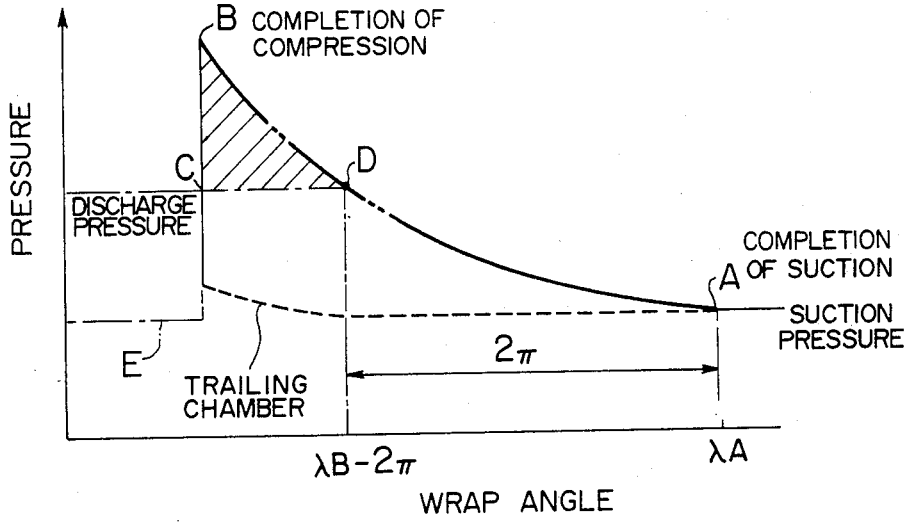
FIGS. 6, 7 and 8 are graphical illustrations of a relationship between the wrap angle and the pressure.

Referring to FIG. 5, the wrap 44 of the orbiting scroll member 4 and the wrap 52 of the stationary scroll member 5 cooperate to define therebetween compression chambers 46, 461, 48 and 481. These compression chambers are progressively moved towards the center of the compressor while decreasing their volumes. More specifically, the compression chamber 46 is formed between points $\lambda A$ and $\lambda A - 2\pi$ at which both wraps contact each other. Similarly, the compression chamber 48 is formed between points $\lambda B$ and $\lambda B - 2\pi$ at which both wraps contact each other. The compression chambers 46 and 48 constitute a pair. Another pair of compression chambers 461 and 481 are formed, respectively, between points $\lambda A - 2\pi$ and $\lambda A - 4\pi$ and between points $\lambda B - 2\pi$ and $\lambda B - 4\pi$ at which both wraps contact each other on the side inwardly of the pressure chambers 46 and 48. The relationship between the position of the point where both wraps contact each other and the pressure in the compression chamber is shown in FIG. 6. It will be seen that the ratio between the suction pressure and the pressure obtained when the compression is completed is constant, and this ratio is determined by factors such as, for example the number of turns of the wraps, configuration of the wraps and so forth. In a case where the pressure in the discharge chamber represented by the line C-D in FIG. 6 is below the level of the final compression pressure indicated by B, the compressor performs unnecessary work, i.e., over-compression, as shown by the hatched area defined by points B, C and D, resulting in a loss of the driving power. This over-compression takes place particularly when the compressor is started in a condition wherein the pressure at the high pressure side of the compressor is balanced with the pressure at the low pressure side as indicated by a line E.

The over-compression prevention valve 100 operates in order to prevent such over-compression in the scroll compressor, as will be understood from the following description.

Figure 7:
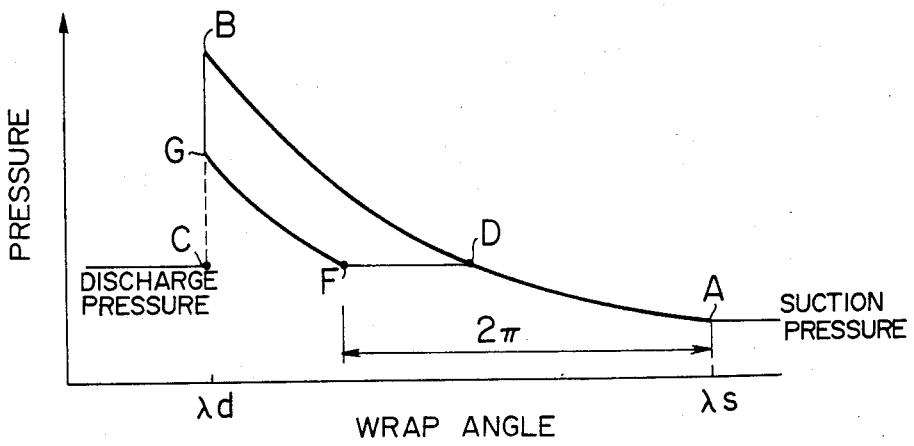
Figure 8:
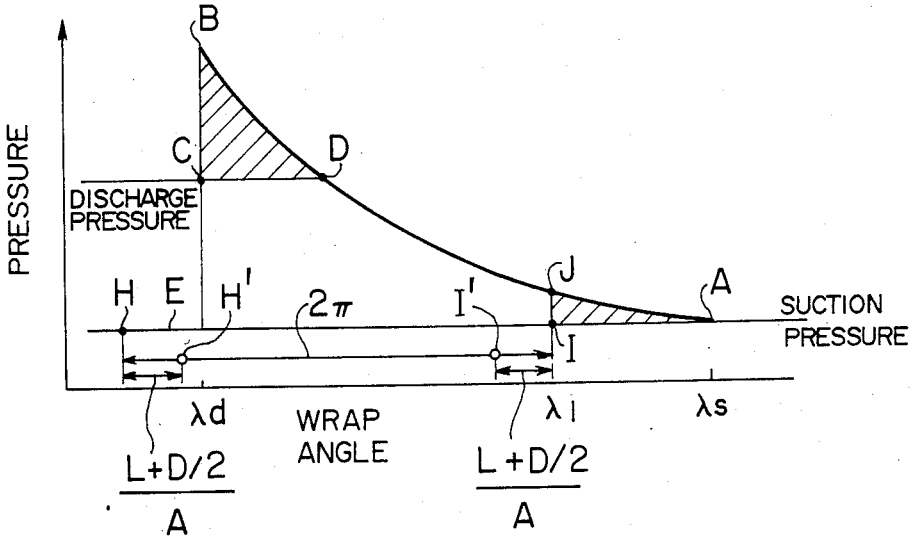

FIG. 7 shows the relationship between the wrap angle and the pressure in the compression chamber obtained when the wrap angle of both scroll wraps is $2\pi$ or greater. Assuming here that the over-compression prevention valve 100 has a communication port which opens in the region between a point A and a point F in FIG. 7, i.e., within an angular range of $2\pi$ between the point λA and λA−2π in FIG. 5, the gas under compression is relieved from the compression chamber into the discharge chamber over the angular region between a point D at which the pressure in the compression chamber reaches the level of the pressure in the discharge chamber and a point F at which the communication port is closed. Thereafter, the pressure in the compression chamber is increased along a curve F-G. Referring now to FIG. 8, assuming that the communication port of the over-compression prevention valve is positioned to open in the region between a point I and a point H which region includes the compression completion point λd and extends over 2π, when the pressure in the discharge chamber is at a level indicated by a line C-D, the pressure in the compression chamber is increased along a curve A-J-D. At the point D, the increase in the pressure in the compression chamber is stopped to prevent over-compression shown by a hatched area defined by the points D, B and C. Additionally, as shown in FIG. 8, if the level of the pressure E in the discharge chamber is below a pressure J which is reached when the communication port starts to open, the pressure in the compression chamber is increased from the point A to the point J where the over-compression prevention valves open the communicating ports so as to relieve the gas into the discharge chamber. Thereafter, the pressure in the compression chamber is maintained at the same level as the pressure E in the discharge chamber, as indicated by the line I-H. According to the invention, a plurality of communication ports which are opened at different wrap angles are combined so as to prevent over-compression all over the entire compression stroke of each compression chamber.

Although, in the described embodiment, a pair of communication ports are associated with each lead valve, this number of the communication ports is only illustrative and the number of the communication ports associated with each lead valve may vary preferably between two and four. It has been determined that the preferred number of the communication ports is about two in case of a compressor for air-conditioning purpose, and three to four for a compressor intended for use with a refrigerating machine.

Any way, the number and positions of the communication holes have to be selected to meet the following condition:

$$0<\lambda(i+1)-\Delta i=\Delta\lambda<2\pi,$$

where λ represents the positions of the communication ports (i=1 to n, i=1 represents the communication port which opens to the compression chamber of the minimum volume), and Δλ represents the distance in terms of the wrap angle between the communication ports which are successively opened.

According to the invention, it is preferred that the diameter of the communication port is smaller than the wall thickness of the wrap, so that there are distinctive time lags between the moment at which the communication port starts to open and the moment at which the communication port is completely opened and between the moment at which the communication port starts to close and the moment at which the communication port is completely closed. The time lag in terms of the wrap angle λ is expressed by the following formula:

$$\text{wrap angle } \lambda=(L+D/2)/A$$

where, L represents the distance between the center of the communication port and the thickness center of the wrap, D represents the diameter of the communication port, and A represents the radius of the basic circle of the involute curve of the wrap. More specifically, referring to FIG. 8, the communication port which opens in the region between the points H and I actually starts to open at the point I and is completely opened at a point I'. This communication port then starts to close at a point H' and is completely closed at the point H.

The advantage of the invention is remarkable particularly in scroll compressors of so-called intermediate-pressure type in which the pressure of the gas which is being compressed is applied to the back face of the orbiting scroll member so as to urge the latter against the stationary scroll member throughout the operation of the compressor. The back-pressure port 45 for transmitting the gas pressure into the back-pressure chamber 62 communicates with the back-pressure chamber over 2π in terms of the wrap angle. Thus, the pressure introduced into the back-pressure chamber 62 is equal to a mean level of the pressure line extending over 2π in terms of the wrap angle in FIG. 7 or in FIG. 8.

For instance, assuming here that the back-pressure port 45 is opened over 2π in terms of the wrap angle from the point A, the pressure in the back-pressure chamber 62 does not exceed the pressure in the discharge chamber in the period between the points A and D, so that the mean value of the pressure in the back-pressure chamber 62 is lower than the pressure in the discharge chamber throughout this period. Referring now to FIG. 8, when the pressure in the discharge chamber is below the level indicated by the point indicated by J, the pressure in the back-pressure chamber 62 exceeds the pressure in the discharge chamber over the period between the point A and the point J. In this period, therefore, the mean value of the pressure in the back-pressure chamber 62 is equal to or higher than the pressure in the discharge chamber.

The rise of the pressure in the back-pressure chamber 62 to a level equal to or higher than the pressure in the discharge chamber would make it impossible to lubricate various parts requiring lubrication because, as explained before, the lubricating oil is supplied by the difference between the discharge pressure acting on the lubricating oil in the lubricating oil reservoir 32 and the pressure in the back-pressure chamber 62. Two cases have been described in connection with FIG. 8: namely, a first case in which the pressure in the discharge chamber is at the level indicated by C and a second case in which the pressure in the discharge chamber is at the level represented by the line E. The fact that the pressure in the discharge chamber is at the level E means that the discharge pressure of the scroll compressor is substantially at the same level as the suction pressure of the scroll compressor. Such a state, however, is rather unreal. Namely, the discharge pressure is actually higher than the suction pressure more or less, so that the pressure in the back-pressure chamber 62 is maintained at a level intermediate between the suction pressure and the discharge pressure, and the difference between the pressure in the back-pressure chamber 62 and the discharge pressure is high enough to ensure a reliable supply of the lubricating oil. It is to be understood, however, if the arrangement is such that the communication port starts to open at the point $\lambda_I$ in terms of the wrap angle, the compressor inevitably performs over-compression in the period between the points λS and $\lambda_I$ with the result that energy represented by the hatched area defined by the points A, J and I is wastefully used.

In order to prevent the over-compression in the period between the points λS and $\lambda_I$, another communication port is provided at such a position that this communication port starts to open at the point A which is expressed by λS in terms of wrap angle and at which the suction of the gas is completed. The distance between the communication ports which are opened successively in accordance with the movement of the same compression chamber should be determined to meet the following condition:

$$0<\Delta\lambda<2\pi,$$

where Δλ represents the distance in terms of the wrap angle.

According to this arrangement, it is possible to prevent any over-compression not only when the compressor is started but also when the compressor is operating steadily.

Figure 9:
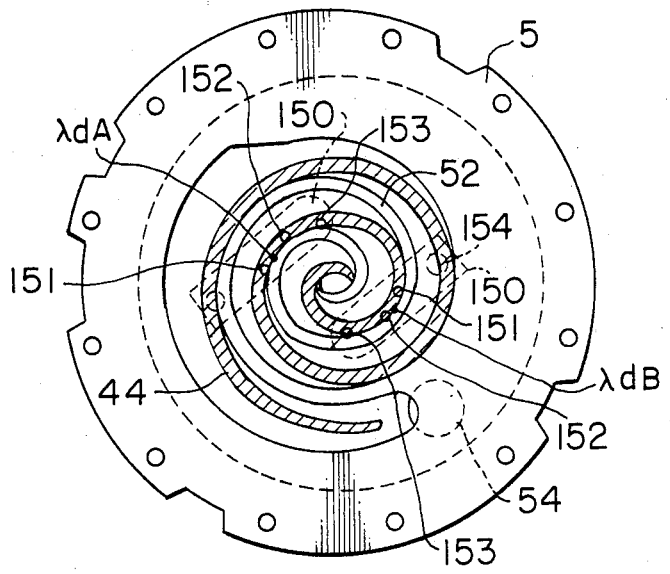
FIGS. 9 and 10 are sectional plan views of different embodiments having three communication ports.

FIG. 9 shows another embodiment of the present invention in which three communication ports 151, 152 and 153 are formed for each over-compression prevention valve 150. The diameter of each communication port is smaller than the wall thickness of each of the wraps 44 and 52. Two communication ports 152 and 153 of the three ports are provided within the regions smaller than the points λdA and λdB in terms of the wrap angle, the points λdA and λdB representing the points at which both wraps contact each other when compression is completed in the respective compression chambers. As in the case of the arrangement shown in FIG. 2, each over-compression prevention valve 150 in the embodiment of FIG. 9 has a lead valve and a valve retainer which are fastened together to the end plate 51 of the stationary scroll member 5 by, for example, a fixing bolt 154.

The other communication port 151 of the three communication ports is provided at a larger wrap angle position and is positioned closer to the fixing bolt 154 of the over-compression prevention valve 150 than other ports. Namely, the aforementioned two communication ports are positioned closer to the free end of the lead valve of the over-compression prevention valve 150.

The pair of over-compression prevention valves 150 are mounted on a pair of valve seats which are formed in parallel with each other in the upper surface of the end plate of the stationary scroll member 5 and which have finely finished surfaces. It will be understood that the parallel arrangement of the valve seats facilitates the machining of the valve seats.

Preferably, the valve seats are formed in a bottom face of a recess as in the case of the embodiment described in connection with FIGS. 1 and 2, so that the length of each communication port is reduced to minimize the amount of gas filling the communication port, thus minimizing any unfavorable effect which may otherwise be caused by expansion of the gas staying in the communication port.

The arrangement that the communication port 151, at the larger wrap angle position, is positioned adjacent to advantageously ensure a smooth operation of the lead valve because the operation of each of the lead valves proceeds from the fixed end towards the free end of the lead valve.

In the embodiment of FIG. 9, three communication ports 151, 152 and 153, associated with each over-compression prevention valve 150, are not disposed on a common straight line but are arranged along a curvilinear line. This, however, is not exclusive and the ports 151, 152, 153 may be arranged on a straight line. Such an arrangement makes it possible to reduce the width of the lead valve.

Figure 10:
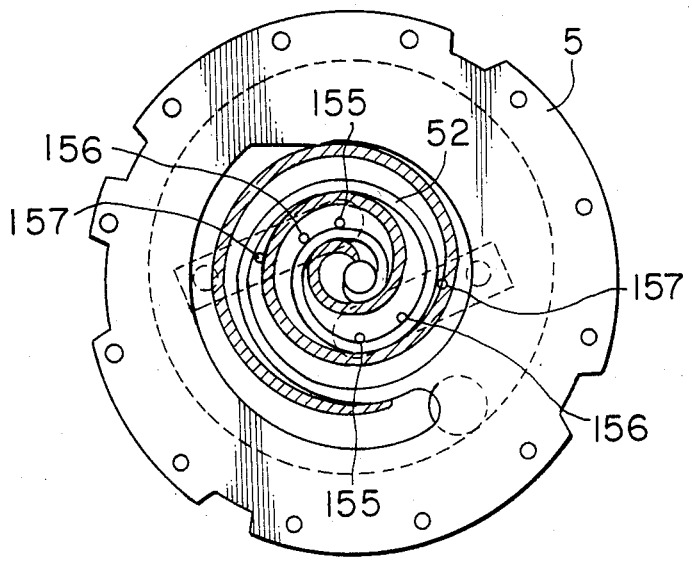

FIG. 10 shows still another embodiment in which three communication ports 155, 156 and 157, associated with each over-compression prevention valve, are arranged on a common straight line in such a manner that each communication port contacts a portion of the wrap wall of the stationary scroll member 5 when viewed in plan. To this end, the diameter D of each communication port, the distance L between each port and the wrap and the thickness T of the wrap are selected to meet the following condition:

$$L+D/2<T.$$

If the diameter D, the distance L and the thickness T are selected to meet the condition of $L+D/2>T$, the communication ports are somewhat spaced from the wall of the wrap 52 of the stationary scroll member 5, so that the machining for forming the communication ports is facilitated. In this case, it is possible that a communication port is opened to a compression chamber which is on the trailing side of a moving space. In such a case, the communication port which opens t the trailing compression chamber effectively prevents any over-compression in the event that over-compression tends to take place in the trailing compression chamber.

Figure 11:
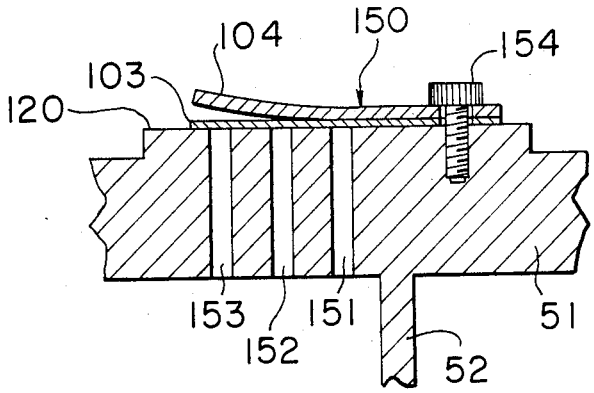
FIG. 11 is a sectional view of an over-compression prevention valve employed in each of the embodiments shown in FIGS. 9 and 10.
Figure 12:
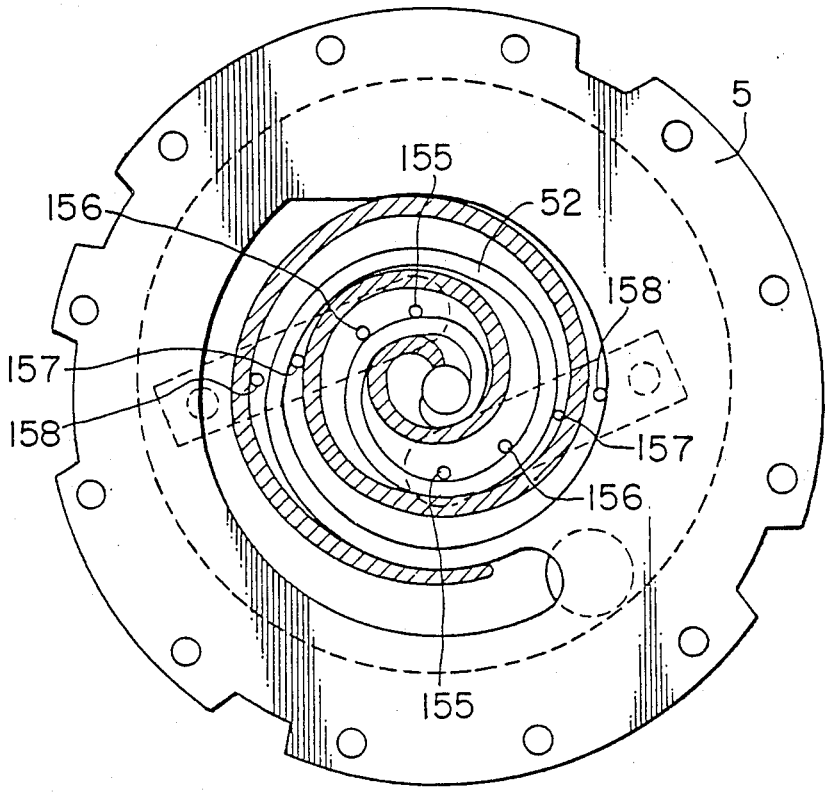
FIG. 12 is a partial sectional view illustrating an embodiment of the present invention in which four communication ports are associated with each of the lead valves.
Figure 13:
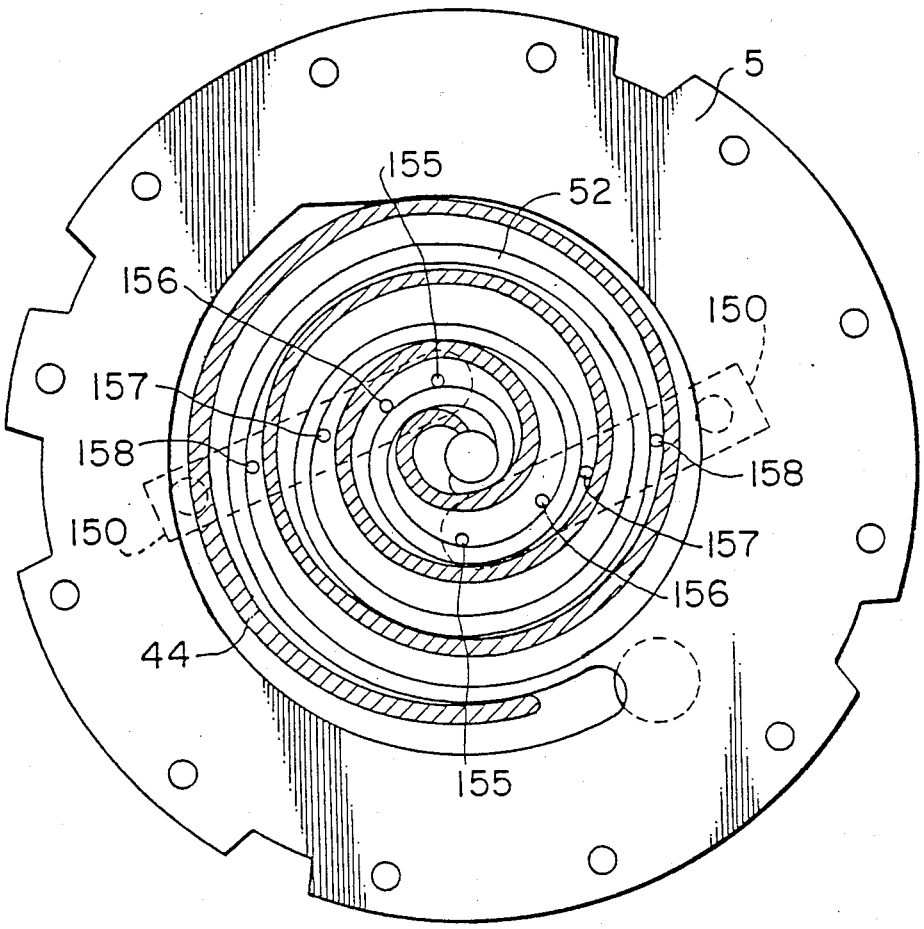
FIG. 13 is a partial sectional view illustrating yet another embodiment in which the number of turns of each wrap is increased and which is particularly suited for refrigerator applications.

FIG. 11 shows a further embodiment of the present invention in which a valve seat 120 is formed on a protrusion formed on the surface of the end plate 51 of the stationary scroll member 5. This arrangement facilitates an easier finishing of the surface of the valve seat 120.

As will be understood from the foregoing description, the scroll compressor in accordance with the present invention is capable of preventing any over-compression which may occur when the compressor operates at a compression ratio smaller than a predetermined value, thus minimizing the loss of the driving power and, accordingly, improving the performance of the compressor. Furthermore, since a plurality of communication ports are provided for each over-compression prevention valve, it is possible not only to reduce the loss of energy attributable to a reduction in the flowing velocity but also to prevent over-compression over the entire period of the compression stroke of each compression chamber. It has also been ascertained that the over-compression prevention means in the scroll compressor of the invention can be applied also to scroll compressors of intermediate-pressure type in which the supply of lubricating oil is effected by a pressure differential caused in the compressor. In such case, a pressure differential large enough to ensure a reliable supply of lubricating oil can be maintained so as to enable the compressor to operate safely over a wider condition of operation.

What is claimed is:

1. A scroll compressor including an orbiting scroll member and a stationary scroll member, each scroll member having an end plate and a substantially spiral wrap protruding substantially perpendicularly from one side of the end plate, said scroll members being assembled with the spiral wraps thereof engaged with each other so that a plurality of closed spaces are defined between said spiral wraps and said end plates to form compression chambers, said orbiting scroll member being adapted to make an orbiting motion with respect to said stationary scroll member so that the compression chambers are progressively moved towards a center of the spiral wrap of said stationary scroll member while the volumes of the compression chambers are progressively decreased to compress a gas sucked into said closed spaces, communication port means for communicating said compression chambers with a discharge chamber in which a discharge pressure is built up, and valve members associated with said communication port means, said valve members being adapted to open an associated communication port means due to a difference in pressure between the compression chamber and said discharge chamber, wherein said communication port means comprises groups of communication ports formed in the end plate of said stationary scroll member, each valve member comprises a lead valve associated with communication ports of one of said groups, a valve seat for the lead valve defined by a planar bottom face of a recess formed in an end face of the stationary scroll member adjacent said discharge chamber, and each lead valve extends along a chord with an outer end fixed to the bottom face and a free inner end in the vicinity of the center of the spiral wrap so as to cooperate with one of the groups of communication ports, and wherein an angular distance, expressed in terms of a wrap angle $\Delta\lambda$, between said communication ports of one group which are successively opened to the same compression chamber in accordance with the orbiting motion of said orbiting scroll member is determined to meet the following condition:

$$0<\Delta\lambda<2\pi$$

2. A scroll compressor according to claim 1, wherein the communication ports are arranged along a substantially straight line.

3. A scroll compressor according to claim 1, wherein each of the valve plates forms lead valves is provided with a valve retainer member and is disposed on a side of the end plate of said stationary scroll member which is adjacent to said discharge chamber.

4. A scroll compressor according to claim 1, wherein said compressor is designed specifically for use in an air-conditioner and wherein the communication port means associated with each lead valve comprises two communication ports.

5. A scroll compressor according to claim 1, wherein said compressor is designed specifically for use in a refrigerator and wherein the number of the communication ports associated with each lead valve is one of three and four.

* * * * *